US007208073B1

(12) United States Patent
Hradil

(10) Patent No.: US 7,208,073 B1
(45) Date of Patent: Apr. 24, 2007

(54) MEDIA FOR USE IN PLATING ELECTRONIC COMPONENTS

(75) Inventor: George Hradil, No. Scituate, RI (US)

(73) Assignee: Technic, Inc., Plainview, NY (US)

( * ) Notice: Subject to any disclaimer, the term of this patent is extended or adjusted under 35 U.S.C. 154(b) by 556 days.

(21) Appl. No.: 10/463,506

(22) Filed: Jun. 16, 2003

Related U.S. Application Data

(60) Provisional application No. 60/400,147, filed on Jul. 31, 2002.

(51) Int. Cl.

| | |
|---|---|
| ***C25D 5/02*** | (2006.01) |
| ***C25D 7/00*** | (2006.01) |
| ***C25D 3/60*** | (2006.01) |
| ***C25D 3/56*** | (2006.01) |
| ***C25D 3/12*** | (2006.01) |

(52) U.S. Cl. ..... 205/128; 205/143; 205/144; 205/145; 205/252; 205/255; 205/271; 205/300

(58) Field of Classification Search ..... 205/143, 205/144, 145, 128, 252, 255, 271, 300
See application file for complete search history.

(56) References Cited

U.S. PATENT DOCUMENTS

| | | | | |
|---|---|---|---|---|
| 3,242,586 | A * | 3/1966 | Peterson | 34/589 |
| 4,272,333 | A * | 6/1981 | Scott et al. | 205/144 |
| 5,487,824 | A | 1/1996 | Griego | 205/128 |
| 5,565,079 | A | 10/1996 | Greigo | 205/67 |
| 6,193,858 | B1 * | 2/2001 | Hradil et al. | 204/222 |
| 6,228,230 | B1 | 5/2001 | Li et al. | 204/222 |
| 6,361,676 | B1 * | 3/2002 | Horie et al. | 205/143 |

FOREIGN PATENT DOCUMENTS

| | | | |
|---|---|---|---|
| JP | 2000256899 | A * | 9/2000 |

* cited by examiner

*Primary Examiner*—Edna Wong
(74) *Attorney, Agent, or Firm*—Winston & Strawn LLP

(57) ABSTRACT

Improvements in methods for plating metal on substrates are obtained by providing media in the plating solution in sizes that are less than 60% to 80% smaller than the average dimension of the substrates to be plated. It is also advantageous for the substrates and media to be present in the solution at a volume ratio of above 1/1 to about 5/1. Another embodiment of the invention relates to an apparatus for electroplating a metal deposit on electroplatable substrates.

18 Claims, 4 Drawing Sheets

PRIOR ART

MEDIA FOR USE IN PLATING ELECTRONIC COMPONENTS

CROSS-REFERENCE TO RELATED APPLICATION

This application claims the benefit of provisional application 60/400,147 filed Jul. 31, 2002, the content of which is expressly incorporated herein by reference thereto.

BACKGROUND OF THE INVENTION

The present invention relates to certain optimally sized and shaped media for use in electroplating composite articles and in particular for electroplating relatively small sized electronic components.

In order to plate composite articles that have both conductive and non-conductive portions, it is generally necessary to add a conductive material to the articles being plated. This conductive material is referred to as media or filler and is typically comprised of metal spheres that are of similar dimensions to the parts to be plated. This media serves the dual function of imparting electrical conductivity to the load and of improving the movement of the parts during the plating process. It is normal practice to use volume ratio of media to articles of at least 1.5/1, with ratios as high as 4/1 or 5/1 not being uncommon. Without the use of media it would be nearly impossible to obtain satisfactory deposition on composite articles using conventional barrel plating equipment. Recently, specialized equipment has been developed with large current feeder areas (U.S. Pat. Nos. 6,193,858, 5,487,824, 5,565,079) which can plate some types of composite articles without media, however, even this equipment requires the use of media in certain situations, such as to plate composite articles that have small conductive areas.

The use of media, although generally necessary, has several drawbacks. Plating times are greatly extended due to the increased surface area attributable to the media. The preponderance of metal is deposited on the media and not on the articles to be plated. Additionally, it is often difficult to separate the media from the plated articles. Moreover, the load size of the articles to be plated in a given plating apparatus is reduced since media consumes a great deal of volume in the plating chamber. Therefore, it is desirable to reduce the volume of media used during plating and to select media that is easily separable from the plated articles. The present invention now resolves these problems and accomplishes the desired goals.

SUMMARY OF THE INVENTION

One embodiment of the invention relates to an improved method for plating metal on substrates having conductive and non-conductive portions. The improvement comprises mixing the substrates with relatively smaller sized conductive media to provide a load of substrates and media that is conductive to electric current. Advantageously, the media is provided in sizes that are at least 40% smaller than the average dimension of the substrates to be plated.

Preferably, the media are provided in sizes that are between about 40 and 60% smaller than the average dimension of the substrates, and the substrates and media are present in the load at a volume ratio of greater than 1/1. More preferably, the media are preferably provided in sizes that are between about 60 and 80% smaller than the average dimension of the substrates, and the substrates and media are present in the load at a volume ratio of between about 2/1 and 5/1.

The media is typically provided as conductive metal objects having sizes of between about 0.1 and 1 mm. This media is non-spherical and typically in the form of generally rectangular or cylindrical copper objects having sizes between about 0.2 and 0.8 mm and a length to width ratio of at least about 0.5/1 to 5/1 and preferably about 1/1 to 4/1.

The load usually includes a plating solution that provides a deposit of tin, tin-lead or nickel, and the substrates are electronic components that are generally rectangular in shape. Thus, the media can be separated from the substrates after plating by sieving.

Another embodiment of the invention relates to an apparatus for electroplating a metal deposit on substrates that have electroplatable portions. The apparatus includes a solution that includes the metal to be deposited and into which the substrates to be electroplated are placed, and media in sizes that are less than 40% smaller than the average dimension of the substrates to be plated. These are contained in a vessel having at least one sidewall and at least one inclined bottom wall that is inclined with respect to the sidewall(s). A solution deflector is mounted in the vessel at a position above the inclined bottom wall(s) such that after contacting the deflector, the solution and substrates flow along the inclined bottom wall(s) and are redirected back towards the deflector. Also, a solution inlet is arranged to provide a flow of solution and substrates into the vessel and towards and against the deflector.

The vessel preferably includes a counterelectrode positioned to contact the solution and the inclined bottom wall(s) constitute an electrode for effecting electroplating of metal from the solution onto the substrates that are circulated with the solution in the vessel. The solution inlet includes a screen that is configured and dimensioned to prevent the substrates from entering into the inlet. A distribution shield can be provided for directing the solution towards the inclined bottom wall(s) after contacting the deflector.

BRIEF DESCRIPTION OF THE DRAWING FIGURES

Figure 3:
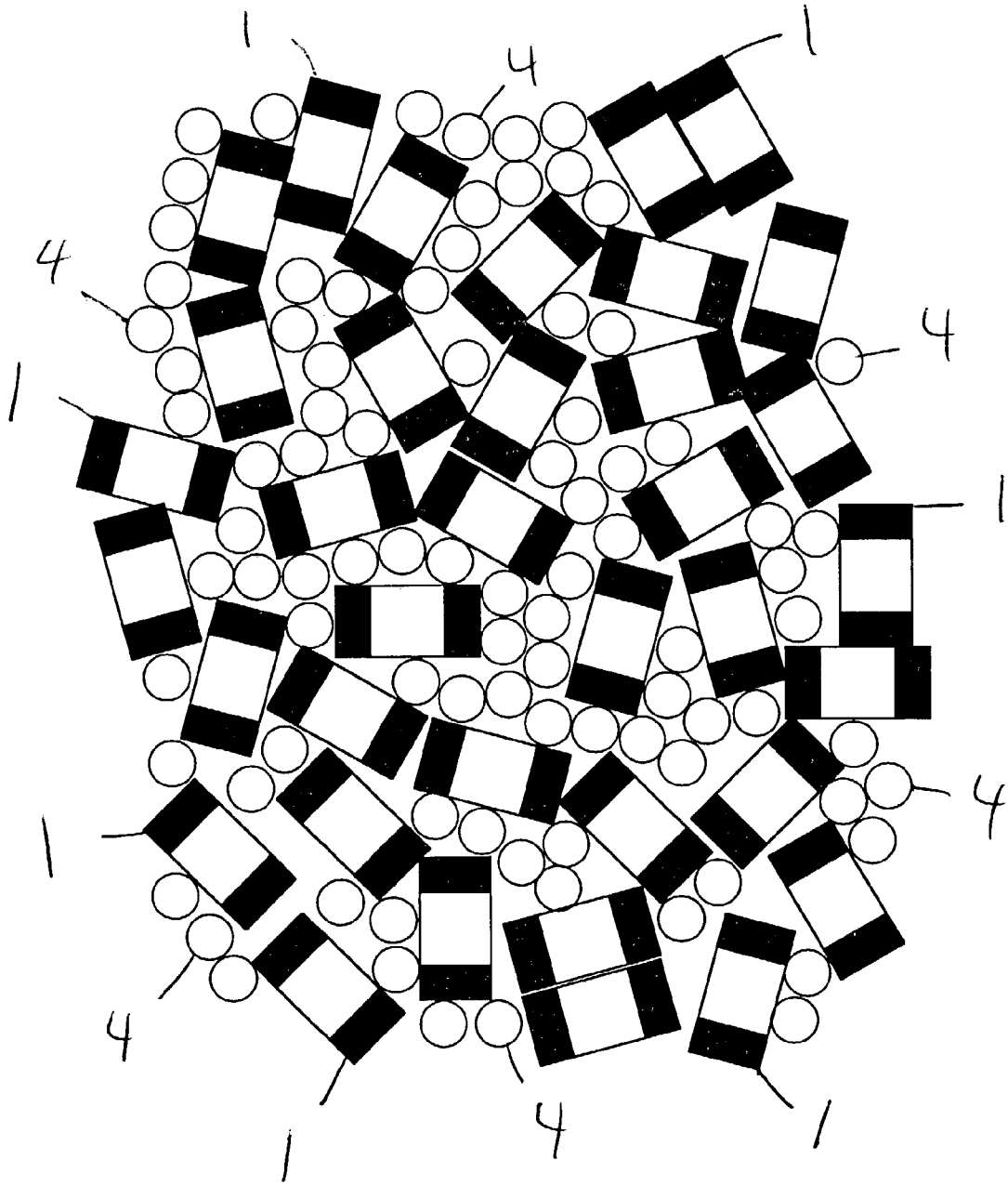
Figure 4:
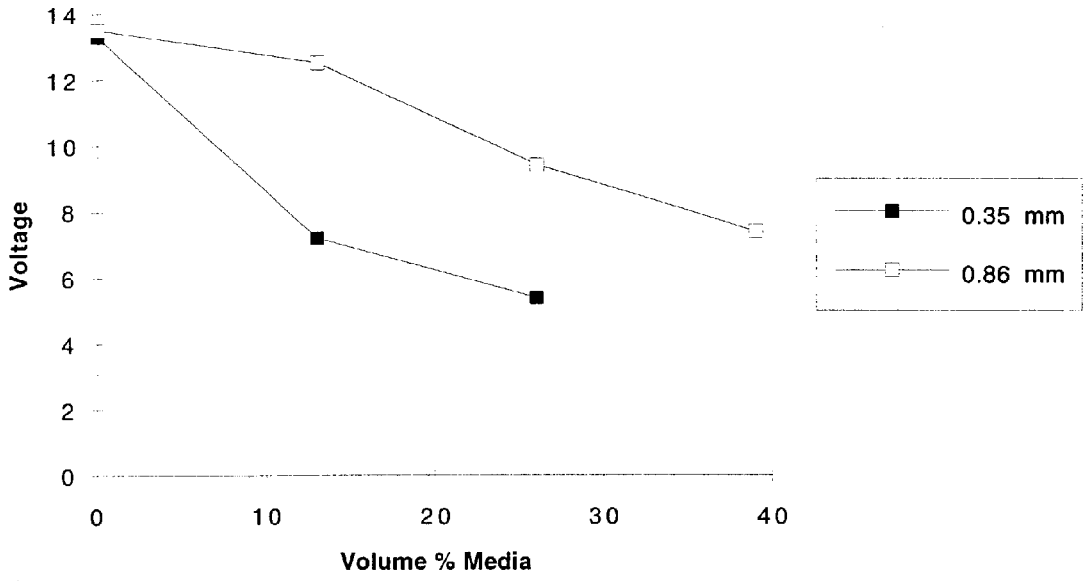

FIG. 3 is a two dimensional representation of a packing of composite electronic components mixed with spherical media 40% smaller than the smallest dimension of the components according to the present invention; and FIG. 4 is a graph illustrating the conductivity of a mixed packing of media and composite electronic components as a function of the volume percentage of media, for two different media sizes, both according to the present invention.

DETAILED DESCRIPTION OF THE PREFERRED EMBODIMENTS

The current invention utilizes media that is significantly smaller than that which is typically used and which in their largest dimension is at least 40% smaller than the average of the substrates. Preferably, the media is at least 40% smaller than the smallest dimension of the substrates to be plated. This smaller size media can be easily separated from the plated substrates by sieving due to the significant size difference between them. Additionally, it has been found that when such small size media is used, a much smaller volume of media is required to successfully electroplate the load. Generally, the volume of the media is less than that of the parts to be plated. As this greatly increases the size of substrate load for a given plating apparatus and significantly reduces the amount of metal deposited on the media, plating times are reduced and plating efficiency is increased.

It is surprising that such small volumes of media can render a load of composite parts conductive for plating. It has now been found that it is not the volume of media that is of primary importance, but rather the number of conductive particles that are provided by the media in the plating solution. Therefore, by using media of a very small particle size, a greater number of conductive pathways are created in the load.

Moreover, it has been found that it is advantageous to use media that is not spherical, particularly when the substrates to be plated are rectangular in geometry. It has been found that it is advantageous to use media that will not roll freely, since this insures that the media and article move together homogeneously during the plating process. This is of particular importance when plating in the spouted bed electrode (SBE) apparatus described in U.S. Pat. No. 6,193,858. When using spherical media in this system, rectangular components tend to "tile" the bottom of the plating chamber with the spherical media simply flowing over the surface of the components. This does not occur when non-spherical media is used.

Furthermore, it has been found that the volume of media can be reduced even further when the media includes conductive segments which have lengths several times that of the widths, such that each segment is capable of conducting current over a substantial distance, while having a small volume, thereby creating long current pathways within the load. This is another feature of the present invention.

Any metal that has sufficient electrical conductivity can be used as the media. In addition, metallized non-conductive media can be used as it would be sufficiently electrically conductive to function in the present invention. Steel, stainless steel, copper or readily available metals are suitable. While those that do not corrode in the plating solution to introduce undesirable ions are preferred, this is not a great concern since the media is generally plated along with the parts to become more resistant to the plating solution.

Although any conductive metal can be used as the media, it is advantageous to utilize media having a size of between about 0.2 and 1 mm, and preferably between 0.3 and 0.8 mm, with a length to width ratio of at least 0.5/1 to 5/1 and preferably 1/1 to 4/1. For use in SBE devices, non-spherical media is preferred. The most preferred media comprises a conductive metal, with steel being preferred from the standpoint of cost and availability. Generally, this type media may be simply obtained by cutting steel wire. If desired, copper, brass or other conductive metals can be used. It is also within the scope of this invention to utilize metallized non-conductive materials such as glass, ceramic or plastic. As metal wire is readily available, it is preferred for that reason. The wire is preferably a flat wire, but cylindrical wire is also suitable. The wire can be partially flattened during the cutting operation and this does not detract from its use or performance in the plating operation. And while spherical media is not preferred, it can be used in certain plating equipment and applications with acceptable results.

When the media is made from wire, the wire can have a diameter in the typical range of from 0.2 to 0.8 mm, and is cut into short lengths ranging from 0.1 to 3 mm. Although the wire has a round circumference, when it is cut, the circumference can be distorted to an oval or even a rounded square or rounded rectangular shape. None of these shapes is critical and any or all of them are useful in the present invention. Also, balls or spheres of that shape can be used, but it is preferable to use cubic or rectangular shaped media for optimum contact with the small sized electronic parts that must be plated, particularly in the SBE device that is described previously. This is true even if the edges and corners of such media are rounded.

The media size is preferably within the range of between about 15 to 60% of the smallest dimension of the substrates to be plated, and more preferably between 20 and 33% of that dimension. These smaller size media present a lesser load in the solution, with less metal plated on the media and more metal plated on the substrates. This increases plating efficiency. Furthermore, the smaller size media can be easily separated from the parts after the plating operation is completed. Simple sieving or screening may be used to remove the substrates from the solution and media for further processing. The solution and media can then be used for plating of additional substrates.

The smaller size media is advantageous in that it unexpectedly provides enhanced contact between articles to be plated even when the volume ratio of articles to media is as high as 4 to 1. It appears that the conductivity of the combined load is more a function of the number of conductive elements rather than the conductive surface area or the volume of the media.

Consider the following relationships between particle size, particle number, and surface area, assuming spherical geometry:

Number of spheres per unit volume$=k_1/r^3$

Surface area of spheres per unit volume$=k_2/r$ where r is the sphere radius.

It is clear from the above relationships that the number of particles per volume increases as a power of three as the particle radius is decreased, while the surface area of the particle increases linearly as the particle radius is decreased. The vastly greater number of conductive particles when using small media allows a greater density of conductive pathways to be formed and also allows better contact between the conductive portion of the articles and the media. In the limiting case where the media was infinitely small it would behave as a conductive liquid with the required volume being only that sufficient to fill the interstitial space of the article packed bed. Any additional media would only serve to mask the article from the current, which is highly undesirable. Generally, the percent volume of media in the mixed load in the present invention is between 20 to less than 50% which is the typical range of void fractions in packed beds. Therefore the use of media substantially smaller than the articles to be plated is highly desirable and allows a smaller percentage of media to comprise the load. Additionally, using media that is at least 40% smaller than the smallest dimension of the articles to be plated allows the parts to be easily separated from the media by sieving.

It is most preferred for all of the media to be of a size where their largest dimension is less than half of the smallest dimension of the substrates to be plated. Advantages in plating can be obtained even if at least some of the conventionally sized media is replaced with the smaller sized media of the invention, as this reduces the volume of media in the solution and provides a greater number of media. The use of media in which a portion of the media and preferably a majority have the smaller sizes described herein are sufficient for certain applications, such as those where the substrates have relatively large conductive portions. The greater than number of smaller size media provides further plating improvements. Thus, it is preferred to use media where at least about 66 to 75% or even 80 to 90% have the smaller sizes described herein. The skilled artisan can readily determine suitable combinations of smaller and larger sized media that can be used for the plating of any particular substrates.

The reason for the effectiveness of the smaller sized media is due to media conforming and filling the interstitial space between the components. This is not possible with larger size media. It has also been observed in the SBE that small media will form a thin layer along the bottom surface of the moving bed of parts, with the majority of part being on the top surface of the bed. Therefore, the small media makes an electrically conductive surface on which the parts rest and make electrical contact. Additionally, since the bed is exposed to the anode current from the top surface, the parts shield the media from metal deposition resulting in the metal being deposited more on the parts than on the media. Thus, there are a number of specific variations that can be made to the media to obtain the benefits of the present invention, and the skilled artisan can readily determine these by routine test plating of any particular substrates.

Another preferred embodiment of the invention relates to an apparatus for electroplating a metal deposit on an electroplatable substrate. This apparatus is essentially as disclosed in U.S. Pat. No. 6,193,858 and PCT application PCT/US00/35413, except that the media to be used in that apparatus has the relatively small sizes disclosed herein. The present invention is also suitable for use with the plating equipment disclosed in U.S. Pat. Nos. 6,228,230, 5,487,824 and 5,565,079. The contents of all four of these patents are expressly incorporated herein by reference thereto. These apparatus are capable of containing small particles, in comparison, conventional barrel plating equipment is usually fouled by particles that are less that 0.5 mm in diameter. However, the method of the current invention may also be practiced in conventional plating barrels for typical 0603 (0.06"×0.03"×0.03") sized components or larger.

The invention is highly useful for plating composite substrates that include conductive portions and non-conductive portions. Generally, these composite substrates have sizes as small as 0.01"×0.01"×0.02" with more typical commodity components having dimension between 0.02"×0.02"×0.04" and 0.1"×0.1"×0.2". These components are rectangular parallelepipeds composed of electrically non-conductive ceramic. These components are terminated by dipping the ends of the part in a conductive paste and firing the part to form the conductive terminations. These terminations must be plated first with a nickel barrier layer and then with a tin or tin alloy to render the termination solderable. These parts are particularly challenging to electroplate because they have both conductive portion (the terminations) and non-conductive ceramic portions. A mass of such parts have a sufficient portion of non-conductive surface area to render the mass non-conductive to electrical current.

The plating solutions that can be used in the present invention are those which are conventionally used for plating such substrates. Generally, these solutions include metals such as nickel and tin or tin-lead. The most preferred solutions are disclosed in U.S. application No. 60/347,050 filed Jan. 11, 2002, the content of which is expressly incorporated herein by reference.

Figure 1:
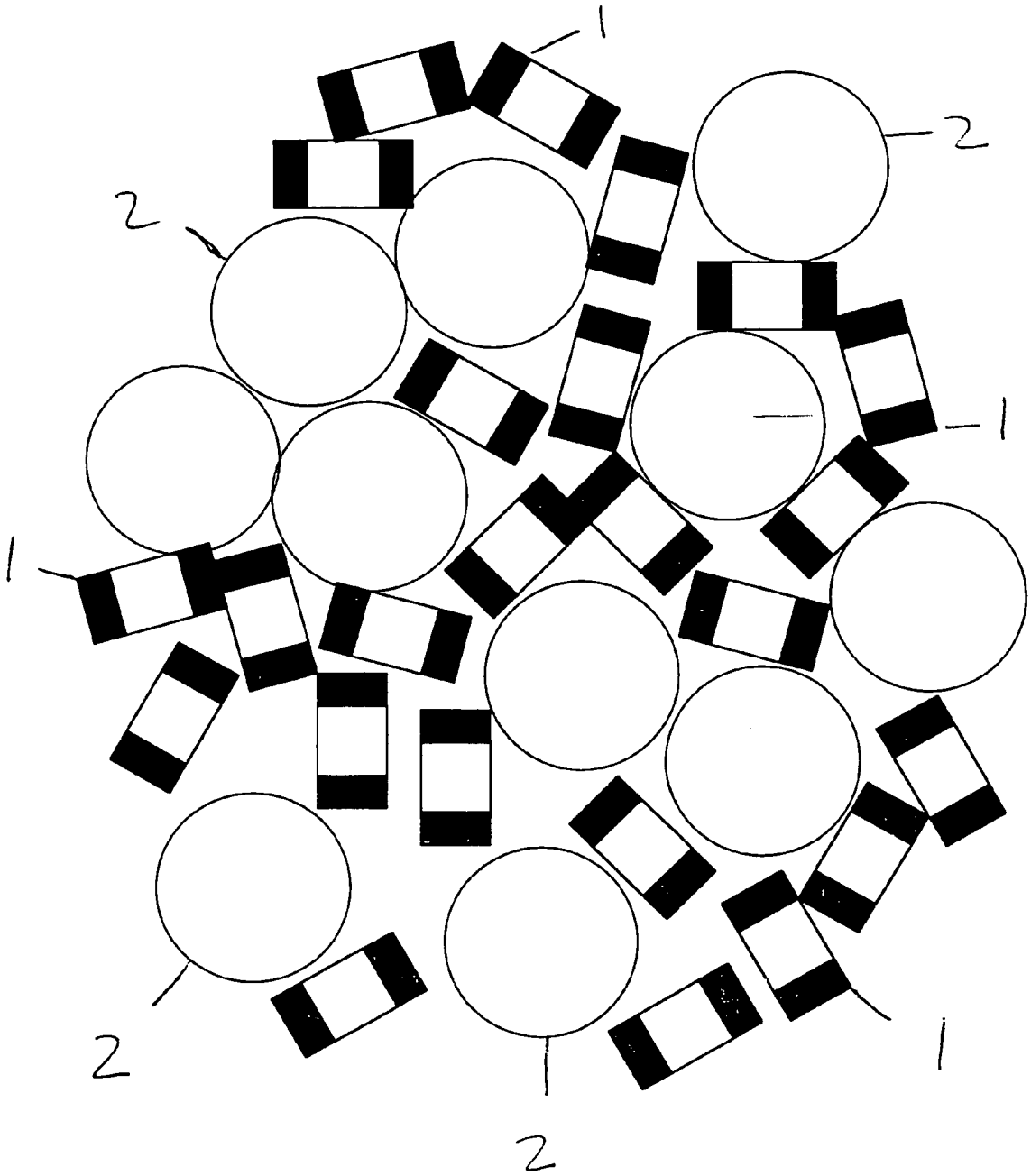
FIG. 1 is a two dimensional representation of a packing of composite electronic components mixed with spherical media of greater dimension than that of the components according to the prior art.

Turning now to the drawings, FIG. 1 illustrates a packing of composite electronic components 1 mixed with spherical media 2 of greater dimensions than that of the electronic components according to the prior art. As shown, not all of the conductive or electroplatable surfaces of the parts contact the media so that incomplete plating on all surfaces results.

Figure 2:
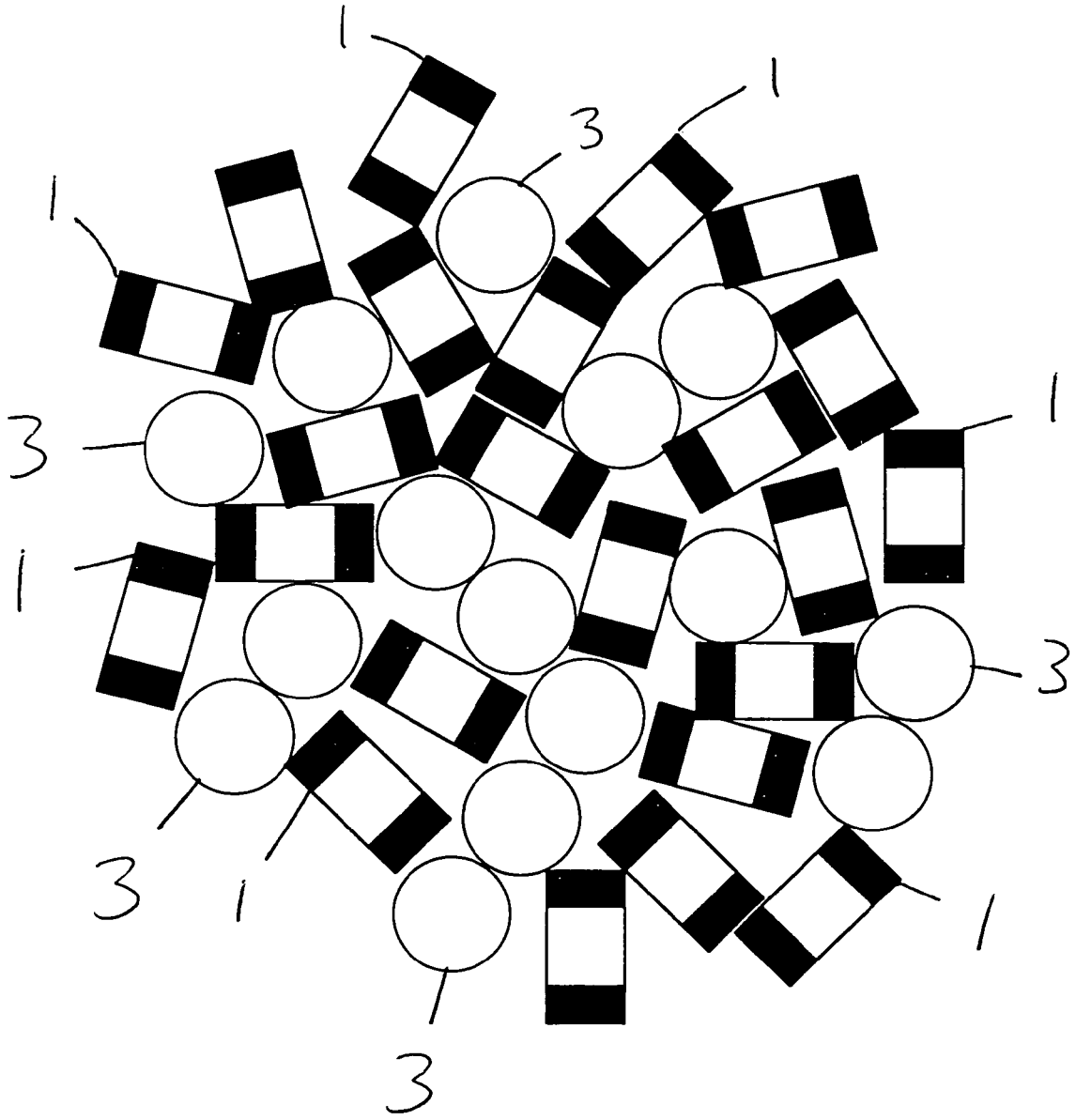
FIG. 2 is a two dimensional representation of a packing of composite electronic components mixed with spherical media of similar dimension as that of the components according to the prior art.

FIG. 2 shows packing of the same size composite electronic components 1 as that of Example 1, but mixed with spherical media of closely similar dimensions 3 to that of the components according to the prior art. Again, plating on all surfaces is incomplete due to insufficient contact of the conductive or electroplatable surfaces of the aprs and the media.

FIG. 3 illustrates a packing of the same size composite electronic components 1 as Example 1 but now mixed with spherical media 4 that is 40% smaller than the smallest dimension of the electronic components 1 as taught by the present invention. While the preferred media would be non-spherical, spherical media is shown for convenience in illustrating the relative size differences of the components and for comparing the sizes of the media of the invention with that of the prior art as set forth in FIGS. 1–2.

Plating performance on all conductive or electroplatable surfaces is improved because the smaller sized media bridges the surfaces of the parts, thus allowing electrical currents to flow to the conductive or electroplatable portions of those parts so that a more complete and uniform coverage of such surfaces is achieved. This following example illustrates this improved performance in further detail.

EXAMPLES

To illustrate the advantages of using media smaller than the articles to be plated the following experiments were conducted using an SBE apparatus according to U.S. Pat. No. 6,193,858.

170 ml of 0402 capacitors was loaded into the plating chamber and the chamber was immersed in a conventional sulfamate nickel electroplating solution at 130° F. The solution included 22.5 g/l nickel chloride, 428 g/l nickel sulfamate, 37.5 μl boric acid and had a pH of 4.4.

The load was circulated in the SBE chamber by an electrolyte stream and a current of 10 A was imposed on the load. The voltage was monitored as small aliquots of conductive media were added to the SBE chamber. The experiment was conducted for 0.86 mm diameter copper cut wire shot and 0.35 mm diameter copper cut wire shot. The results are given in FIG. 4. As can be seen, even a 13% addition of the 0.35 diameter mm media results in a substantial reduction in voltage, while a similar addition of the 0.86 mm diameter cut wire shot resulted in only a modest reduction in voltage.

FIG. 4 also shows that the load can be rendered conductive at much lower ratios of media to parts than when using larger sized media. This is a surprising result, as the use of smaller size media allows lower media to parts ratios resulting in a reduced consumption of media, an increased load capacity for parts, decreased plating times and plating currents, better coverage and quality of plated metal coatings, and an easy separation of parts and media. All these features support the patentability of the invention.

What is claimed is:

1. A method for electroplating metal on substrates having conductive and non-conductive portions, which comprises combining the substrates with non-spherical conductive media in a solution to provide a load that is conductive to electric current wherein the media is provided in sizes that are at least 40% smaller than the average dimension of the substrates to be plated such that a moving bed of the substrates and media is created, with the media forming an electrically conductive layer beneath the substrates, and applying a current from above the substrates such that the substrates shield the media resulting in the metal being electroplated more on the substrates than on the media.

2. The method of claim 1 wherein the media are provided in sizes that are between about 40 and 60% smaller than the average dimension of the substrates, and the substrates and the media are present in the load at a volume ratio of at least about 1/1 to 4/1.

3. The method of claim 1 wherein the media are provided in sizes that are between about 60 and 80% smaller than the average dimension of the substrates.

4. The method of claim 1 wherein the media comprises conductive metal objects having sizes of between about 0.1 and 1 mm.

5. The method of claim 4, wherein the non-spherical conductive media comprises generally rectangular or cylindrical metal objects having sizes between about 0.2 and 0.8 mm and a length to width ratio of at least about 0.5/1 to 5/1.

6. The method of claim 5 wherein the metal objects have a length to width ratio of about 1/1 to 4/1.

7. The method of claim 1 wherein the solution includes metal compounds of tin, tin-lead or nickel in order to provide the metal electrodeposit in the form of a tin, tin-lead or nickel electrodeposit.

8. The method of claim 1 wherein the substrates are electronic components that are generally rectangular in shape.

9. The method of claim 1 wherein the media are separated from the substrates after plating by sieving.

10. A method for electroplating metal on substrates having conductive and non-conductive portions, which comprises combining the substrates with non-spherical conductive media in a solution to provide a load that is conductive to electric current, wherein the media is provided in sizes that are at least 40% smaller than the average dimension of the substrates to be plated, with the combining conducted in an apparatus that comprises:

a solution that includes the metal to be electroplated and into which the substrates and media are placed;

a vessel having at least one sidewall and at least one inclined bottom wall that is inclined with respect to the sidewall(s);

a solution deflector mounted in the vessel at a position above the inclined bottom wall(s) such that after contacting the deflector, the solution and substrates flow along the inclined bottom wall(s) and are redirected back towards the deflector; and a solution inlet arranged to provide a flow of solution and substrates into the vessel and towards and against the deflector, such that a moving bed of the substrates and media is created, with the media forming an electrically conductive layer beneath the substrates, and applying a current from above the substrates such that the substrates shield the media resulting in the metal being electroplated more on the substrates than on the media.

11. The method of claim 10, which further comprises providing the vessel with a counterelectrode positioned to contact the solution and the inclined bottom wall(s) and constituting an electrode for effecting electroplating of the metal from the solution onto the substrates that are circulated with the solution in the vessel.

12. The method of claim 10, which further comprises providing the solution inlet with a screen that is configured and dimensioned to prevent the substrates from entering into the inlet.

13. The method of claim 10, which further comprises providing the vessel with a distribution shield for directing the solution towards the inclined bottom wall(s) after contacting the deflector.

14. The method of claim 10, which further comprises providing the media in sizes that are between about 40 and 60% smaller that the average dimension of the substrates, and providing the substrates and media in the solution at a volume ratio of at least about 1/1 to 4/1.

15. The method of claim 10, wherein the media comprises conductive metal objects having sizes of between about 0.30 and 1 mm.

16. The method of claim 10, wherein the media comprises generally rectangular or cylindrical metal objects having sizes between about 0.2 and 0.8 mm and a length to width ratio of at least about 0.5/1 to 5/1.

17. The method of claim 16, wherein the solution contains metal compounds of tin, tin-lead or nickel in order to provide the metal electrodeposit in the form of a tin, tin-lead or nickel electrodeposit.

18. The method of claim 17, wherein the substrates are electronic components that are generally rectangular in shape.

* * * * *